US006202239B1

(12) United States Patent
Ward et al.

(10) Patent No.: US 6,202,239 B1
(45) Date of Patent: Mar. 20, 2001

(54) MULTI-ZONE SUPPORT

(75) Inventors: Kevin Ward, Anoka, MN (US); Steve Hawkins, Richmond, VA (US)

(73) Assignee: Select Comfort Corp., Plymouth, MN (US)

( * ) Notice: Subject to any disclaimer, the term of this patent is extended or adjusted under 35 U.S.C. 154(b) by 0 days.

(21) Appl. No.: 09/257,404

(22) Filed: Feb. 25, 1999

Related U.S. Application Data

(60) Provisional application No. 60/075,857, filed on Feb. 25, 1998.

(51) Int. Cl.[7] ..... A47C 27/18

(52) U.S. Cl. ..... 5/727; 5/713; 5/736; 5/740; 5/724

(58) Field of Search ..... 5/691, 713, 724, 5/727, 728, 736, 740

(56) References Cited

U.S. PATENT DOCUMENTS

| | | | | |
|---|---|---|---|---|
| D. 383,349 | | 9/1997 | Steelman et al. . | |
| 3,166,768 | * | 1/1965 | Cunningham | 5/718 |
| 3,521,311 | * | 7/1970 | Cohen | 5/740 |
| 3,846,857 | * | 11/1974 | Weinstock | 5/727 |
| 4,306,322 | | 12/1981 | Young et al. . | |
| 4,435,864 | | 3/1984 | Callaway . | |
| 4,580,301 | * | 4/1986 | Ludman et al. | 5/727 X |
| 4,622,706 | | 11/1986 | Takeuchi . | |
| 4,682,378 | | 7/1987 | Savenije . | |
| 4,706,313 | | 11/1987 | Murphy . | |
| 4,843,666 | | 7/1989 | Elesh et al. . | |
| 4,897,890 | | 2/1990 | Walker . | |
| 4,947,500 | * | 8/1990 | Seiler | 5/713 |
| 4,972,535 | | 11/1990 | Goldman . | |
| 4,986,738 | | 1/1991 | Kawasaki et al. . | |
| 5,025,519 | | 6/1991 | Spann et al. . | |
| 5,044,029 | | 9/1991 | Vrzalik . | |
| 5,051,673 | | 9/1991 | Goodwin . | |
| 5,072,469 | | 12/1991 | Boyd . | |
| 5,105,488 | | 4/1992 | Hutchinson et al. . | |
| 5,127,119 | * | 7/1992 | Rogers | 5/730 |
| 5,136,740 | | 8/1992 | Kraft . | |
| 5,179,742 | * | 1/1993 | Oberle | 5/727 |
| 5,394,577 | * | 3/1995 | James et al. | 5/713 |
| 5,430,901 | * | 7/1995 | Farley | 5/728 X |
| 5,509,154 | | 4/1996 | Shafer et al. . | |
| 5,581,828 | | 12/1996 | Price . | |
| 5,606,756 | | 3/1997 | Price . | |
| 5,652,484 | | 7/1997 | Shafer et al. . | |
| 5,669,094 | * | 9/1997 | Swanson | 5/740 |
| 5,699,570 | * | 12/1997 | Wilkinson et al. | 5/713 |
| 5,815,865 | | 10/1998 | Washburn et al. . | |
| 5,903,941 | | 5/1999 | Shafer et al. . | |
| 6,041,459 | * | 3/2000 | Nunez et al. | 5/740 X |

FOREIGN PATENT DOCUMENTS

| | | | | |
|---|---|---|---|---|
| 1 178 719 | | 11/1984 | (CA) . | |
| 1 224 888 | | 7/1987 | (CA) . | |
| 678 390 A5 | | 9/1991 | (CH) . | |
| 2274054A | * | 7/1994 | (GB) | 5/724 |
| WO 97/1961 | | 6/1997 | (WO) . | |

* cited by examiner

*Primary Examiner*—Michael F. Trettel
(74) *Attorney, Agent, or Firm*—Oppenheimer, Wolff & Donnelly

(57) ABSTRACT

A multi-zone support generally includes a top foam layer, a middle foam layer located beneath the top foam layer, and a bottom foam layer located beneath the middle foam layer. The resistance to a compressing force generally increases per layer from top to bottom. The top layer has a top and bottom planar surface. The middle layer incorporates five zones of support. Three of the zones include a sinusoidal surface for supporting the head/shoulder, hips, and legs/feet while the other two zones include a sold surface for supporting the back and thighs. The bottom surface includes a number of channels, the channels help to carry heat and moisture away from the support.

39 Claims, 3 Drawing Sheets

MULTI-ZONE SUPPORT

CLAIM TO PRIORITY

The present application claims priority to U.S. provisional application having Ser. No. 60/075,857, filed Feb. 25, 1998, now lapsed and entitled "Multi-Zone Support." This provisional application is incorporated by reference herein.

FIELD OF THE INVENTION

This invention relates to supports for the human body and, more particularly, to supports having different degrees of support corresponding generally to the pressure points exhibited by the human anatomy.

BACKGROUND OF THE INVENTION

Support apparatus' for humans reposing in a generally horizontal disposition range from near board-like firmness to near down pillow-like softness. Most people find that a support that is somewhere between the two aforementioned extremes is the most desirable. There are compromises to be made in manufacturing such a support that universally accommodates humans of different sizes, and more particularly, weights.

As such, there is a need in the sleep industry to provide a support that is deemed to be comfortable by humans having a wide range of physical characteristics.

SUMMARY OF THE INVENTION

The needs described above are in large measure solved by a multi-zone support of the present invention. The multi-zone support generally includes a top foam layer, a middle foam layer located beneath the top foam layer, and a bottom foam layer located beneath the middle foam layer. The resistance to a compressing force generally increases per layer from top to bottom. The top layer has a top and bottom planar surface. The middle layer incorporates five zones of support. Three of the zones include a sinusoidal surface for supporting the head/shoulder, hips, and legs/feet while the other two zones include a solid surface for supporting the back and thighs. The bottom surface includes a number of channels that help to carry heat and moisture away from the support. Each of the layers is preferably coated with an anti-microbial agent to help provide a barrier against mold and mildew.

Multi-zone support may be used alone or as a component of an overall sleep system. The sleep system additionally and preferably includes a pillow top, that is located just above the top layer, and a fluid support system. The fluid support system generally includes one or more air bladders, an air pump and a remote control that allows a user to adjust the air pressure in the air bladders.

The multi-zone support, alone or as part of a sleep system, is designed to put more of the user's body in substantial weight supporting contact with the support to aid in distributing weight across the entire support and to aid in eliminating body pressure points, e.g. head, shoulders, hips and feet, that are usually associated with common, spring-supported mattresses.

DESCRIPTION OF THE PREFERRED EMBODIMENTS

Figure 1:
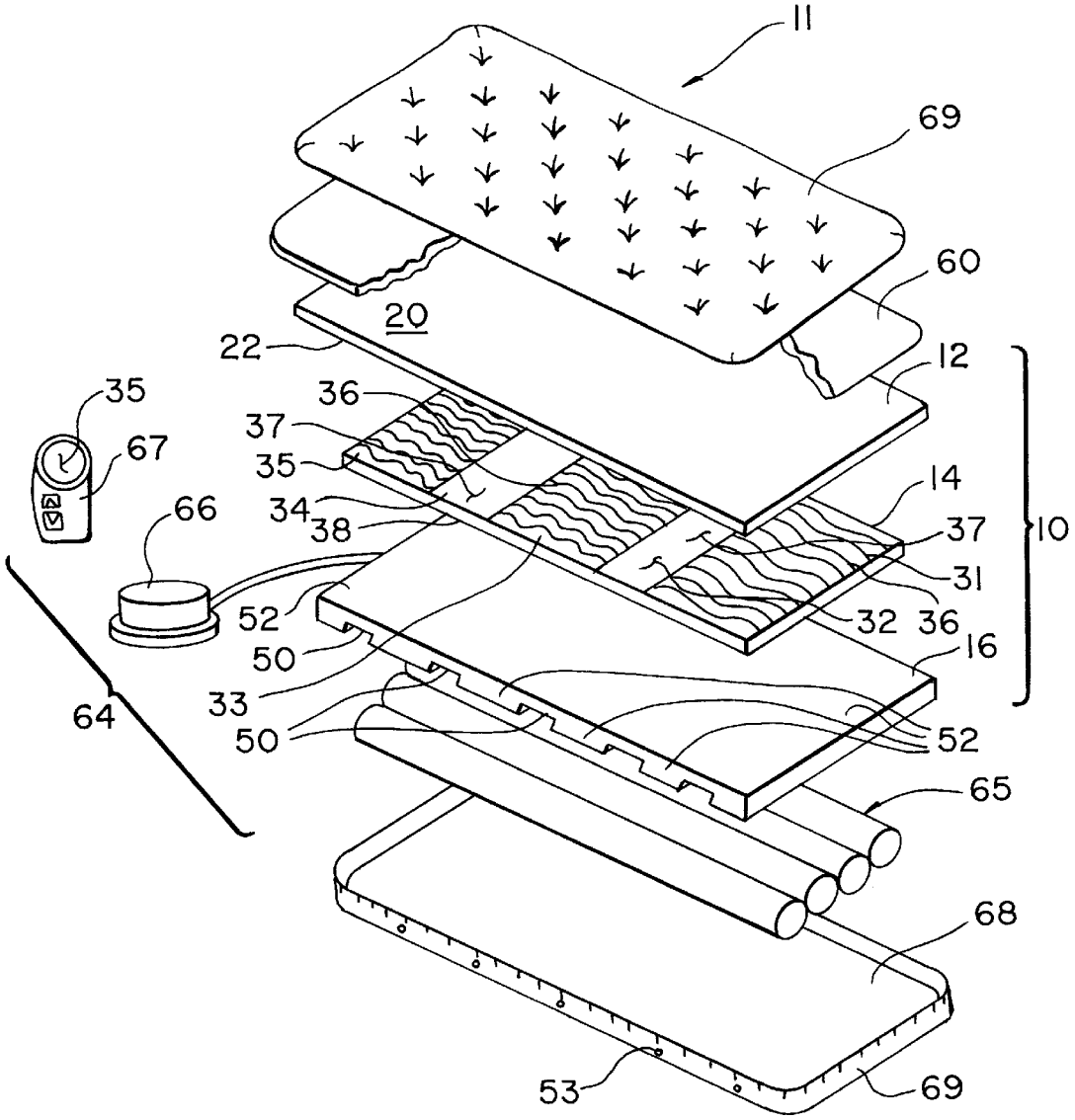
FIG. 1 provides an assembly view of a multi-zone support of the present invention and of other body support components with which the multi-zone support is preferably used.

A multi-zone support 10, depicted in FIG. 1, of the present invention generally comprises a three-layer foam system that includes a top foam layer 12, a middle foam layer 14, and a bottom foam layer 16. Multi-zone support 10 may be used on its own or as part of a sleep system 11.

Top foam layer 12, as shown in FIG. 1 is preferably rectangular in shape having a substantially planar top surface 20 and bottom surface 22. Top foam layer 12 preferably comprises a visco-elastic, polyurethane polyether foam (type V3315) that is approximately one inch thick, having a density in the range of 3.1 to 3.5 pcf (pounds per cubic foot), and an indentation load deflection (ILD) in the range of 15–21. The visco-elastic foam that preferably forms top foam layer 12 was originally developed by NASA to protect astronauts against the pressures of high G-forces. Visco-elastic foam is a heavy, plush foam that can actually sense the body's weight and temperature. Visco-elastic foam responds to the sensed weight and temperature by cradling and forming itself to the entire body. The visco-elastic foam of top layer 12 is preferably treated with an antimicrobial agent to help provide a barrier against mold and mildew.

Figure 2A:
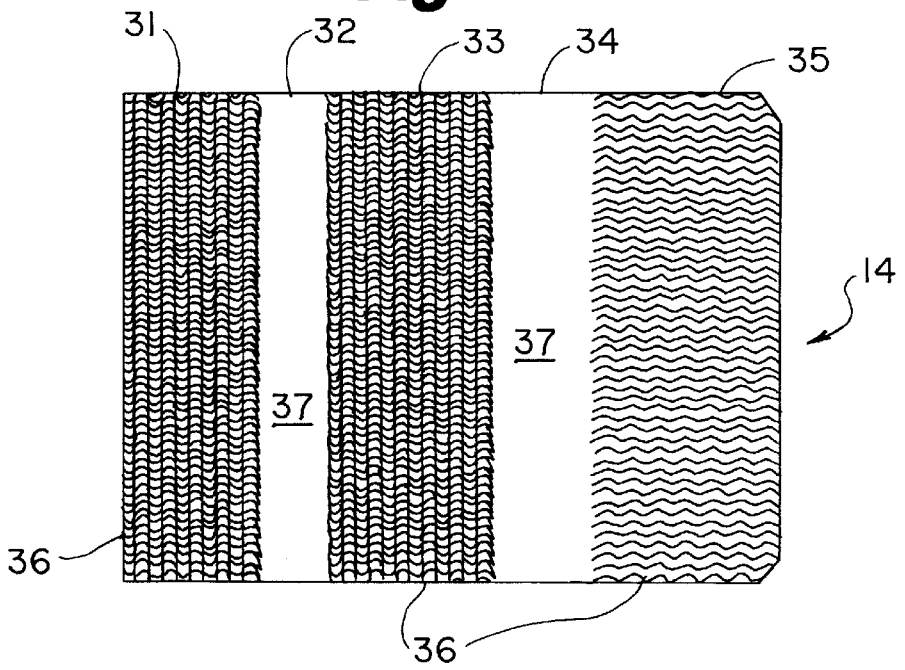
FIG. 2A provides a top plan view of a middle layer of the multi-zone support.

Middle foam layer 14, shown in FIGS. 1 and 2A, is preferably formed from a polyurethane polyether foam (type Q31) that begins with a thickness of 2 inches, and has a density in the range of 2.75 to 3.00 pcf and an ILD in the range of 35–40; middle foam layer 14 is less compressible than top foam layer 12. As with top foam layer 12, middle foam layer 14 is preferably treated with an antimicrobial agent to help provide a barrier against mold and mildew. Middle foam layer 14 preferably incorporates five identifiable zones. Zones one 31, three 33, and five 35 are designed to support the head/shoulders of a user, the hips of a user and the legs/feet of a user, respectively, and are preferably provided with a top surface, sculpted sinusoidal pattern 36. Zones two 32 and four 34 are designed to support the back and thighs of a user, respectively, and preferably provide a substantially planar, solid top 37 and bottom 38 surface; the planar, solid nature provides resistance to deflection.

Figure 2B:
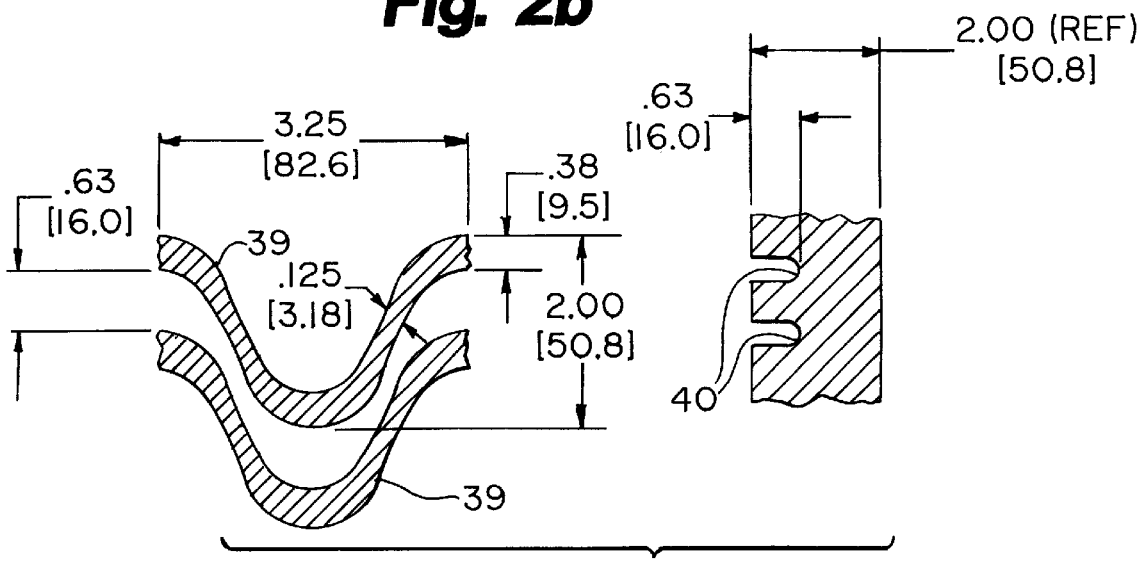
FIG. 2B provides a detail view of a sinusoidal pattern of the middle layer.
Figure 2C:
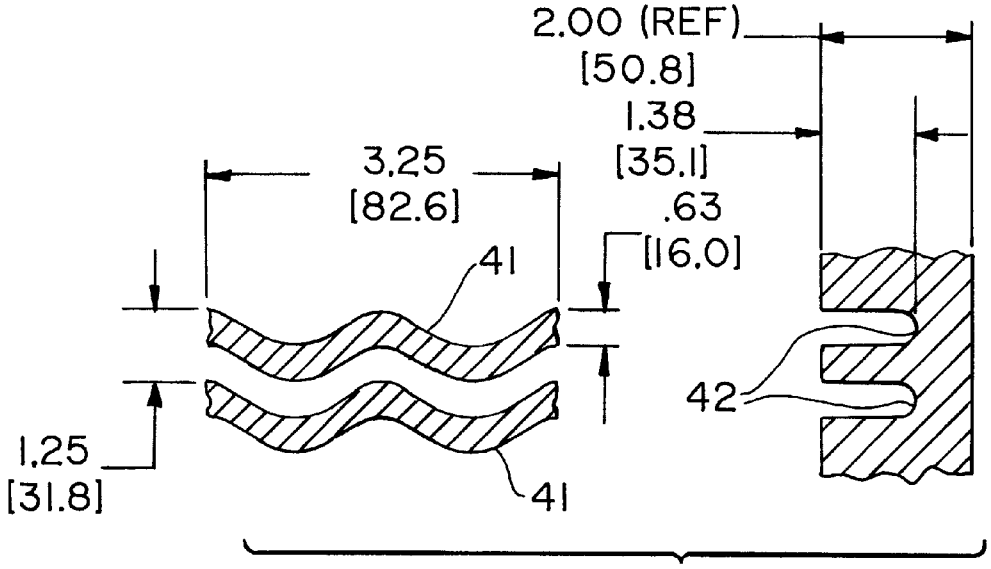
FIG. 2C provides a detail view of a sinusoidal pattern of the middle layer.

Sculpted sinusoidal pattern 36 of zones one 31, three 33, and five 35 provide variations in firmness, or resistance to deflection, by providing variations in the overall wave geometry, e.g. variations in amplitude, depth of cut, thickness of profile, etc., in each zone. As such, each zone is designed to reduce the pressure on the body at the head/shoulders, hips, and legs/feet of a user of virtually any body size. The preferred variations for each zone are as follows: (1) Zone one 31 and zone three 33 preferably include a sinusoidal pattern wherein sinusoids 39, depicted in FIG. 2B, have a deamplitude of approximately two inches and a half-cycle occurring approximately every 3.25 inches. The foam forming sinusoids 39 preferably has a width of 0.38 inches at its widest and a width of 0.125 at its narrowest. Foam sinusoids 39 are preferably separated by channels 40 that are 0.63 inches in width and 0.63 inches in depth; (2) Zone five 35 preferably includes a sinusoidal pattern wherein sinusoids 41, depicted in FIG. 2C, have a deamplitude of approximately 0.63 inches and two cycles occurring every 3.25 inches. The foam forming sinusoids 41 preferably has a width of 0.63 inches. Foam sinusoids 41 are preferably separated by channels 42 that are 0.63 inches in width and 1.38 inches in depth.

Figure 3:
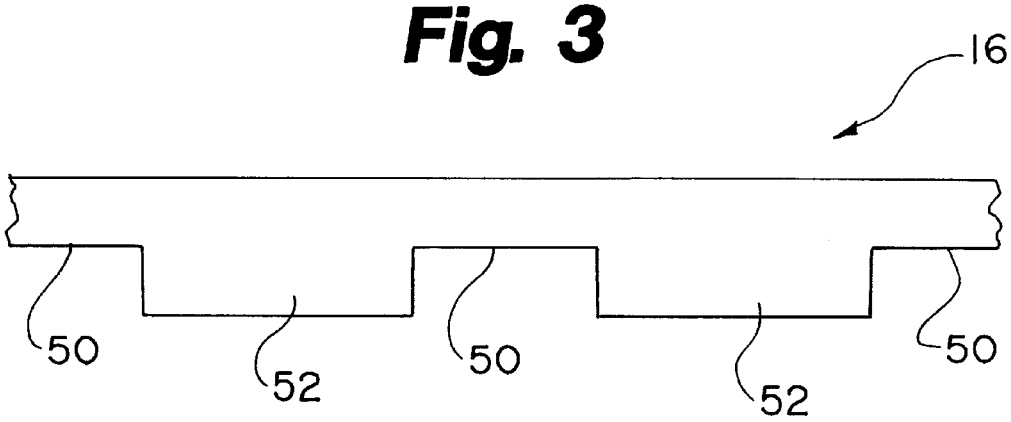
FIG. 3 provides a side section view of a portion of a bottom layer of the multi-zone support.

Bottom foam layer 16, shown in FIGS. 1 and 3, is preferably formed of a 1.5 inch thick, polyurethane polyether foam (Type Q61Z) having a density in the range of 3.00 to 3.25 pcf and an ILD of 65–75; bottom foam layer 16 is less compressible than middle foam layer 14. Bottom foam layer 16 is also preferably treated with an antimicrobial agent to help create a barrier against mold and mildew. Bottom foam layer is also preferably provided with a plurality of transverse channels 50 that are preferably 0.75 inches in depth and 2.00 inches in width. Transverse channels 50 are preferably separated by transverse areas 52 that are 3.00 inches in width. Of course, other dimensions may be used without departing from the spirit or scope of the invention. Bottom foam layer 16 is designed to be quite firm in order to provide support along the user's entire body length. Transverse channels 50 are strategically placed to carry heat and moisture away from the mattress through tiny vents 53 which are placed circumferentially around casing 69 (described below). By carrying away heat and moisture, transverse channels 50 help the user to sleep cooler, dryer, and, as such, more comfortably.

Multi-zone support 10 as described above provides a progression of firmness from top layer 12 down to bottom layer 16. The increasing firmness of each layer allows layers 12, 14, and 16 to act together to provide support for virtually any body weight. In essence, soft top layer 12 acts to provide support for very light weight users while bottom layer 16 acts to provide support for very heavy users. The combination of top layer 12, middle layer 14 and bottom layer 16 provide for relatively consistent support for all user body sizes in between the very light and the very heavy.

Multi-zone support 10, is preferably used as part of a sleep system 11 which preferably includes a pillow top 60, shown in FIG. 1. Pillow top 60 may be any number of materials to provide extra comfort and cushion to the user such as foam, cotton, wool, cashmere and micro-denier. First foam layer 12 is preferably located immediately beneath pillow top 60, however, a fabric layer (not shown) may separate first foam layer 12 from pillow top 60.

Sleep system 11 also preferably includes a fluid support system 64, shown in FIG. 1. Fluid support system 64 is more specifically described in U.S. Pat. Nos. 5,509,154, 4,908,89, 4,829,616, 4,890,344, and 5,652,484 which are hereby incorporated by reference. In general, fluid support system 64 includes one or more air bladders 65, that are preferably placed immediately beneath multi-zone support 10, as well as an air pump 66 and a remote control 67. Air bladders 65 are operably connected to air pump 66 which is operated by remote control 67. Remote control 67 allows a user to selected a desired sleep number, e.g. any number between 0 and 100, to which air pump 66 responds by increasing or decreasing the air pressure in air bladders 65.

In larger sleep systems 11, each side of the sleep support is preferably provided with one or more air bladders 65 to allow two users to adjust the firmness of their side to their own comfort level. Pillow top 60, multi-zone support 10 and air bladders 65 of fluid support system 64 are preferably enclosed in a structure 68 that is encased in a fabric casing 69.

Using fluid support system 64 in combination with multi-zone support 10, allows the user/users to control the volume of air that is supplied to air bladders 65 and, as such, also allows the user to maximize the amount of surface area that is in contact with his or her body. The greater the portions of the body touching the body support, the more evenly the bodyweight is distributed. Thus, there is less pressure that is exerted on a single point of the body and the user is provided with more comfort and more overall body support.

Using fluid support system 64 in combination with multi-zone support 10 provides the user with both comfort and support. For instance, for a user who likes their sleep support to be quite soft, air bladder 65 is maintained in a substantially non-pressurized state, i.e. soft, allowing multi-zone support 10 to contour to the user's body, giving proper support to the areas that need it most, like the back. The contouring also relieves pressure in areas like the shoulders and hips. In a soft configuration, multi-zone support 10 operates mostly as a cushion for comfort and zones 31–35 have little or no affect as multi-zone support 10 tends to also contour to air bladder 65.

For a user who likes a firm sleep support, a standard mattress generally provides little support to the back and presents extreme pressure at the shoulders and hips. However, using fluid support system 64, with air bladders 65 at high or maximum pressure, in combination with multi-zone support 10 provides comfort and support to the user. The hardness of air bladders 65 drive zones 31–35 firmer into the user's body, providing support, while foam layers 12, 14, 16 still allow for a cushion feeling. Thus, whether the desired sleep support is soft or firm, the combination of fluid support system 64 and multi-zone support 10 provides both support and comfort.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed:

1. A body support comprising:

a support member consisting of five zones of support extending transversely and being arrayed from a head of said support member to a foot of said support member, said five zones of support affording varying degrees of resistance to a compressing force applied thereto, wherein at least one of said five zones of support has a sinusoidal surface and wherein at least one of said five zones of support has a solid surface.

2. The body support of claim 1, wherein at least one of said five zones of support has a sinusoidal surface and wherein at least one of said five zones of support has a solid surface.

3. The body support of claim 1, wherein the resistance to said compressive force increases per zone from said head to said foot.

4. The body support of claim 1, wherein the resistance to said compressive force increases per zone from said head to said foot.

5. The body support of claim 1, wherein said zone with said sinusoidal surface is a support section selected from the group consisting of: a head/shoulders support section, a hips support section and a legs/feet support section.

6. The body support of claim 1, wherein said zone with said solid surface is a support section selected from a group consisting of: a back support section and a thighs support section.

7. The body support of claim 1, wherein said sinusoidal surface varies in frequency from approximately 0.1 cycles per inch to 0.6 cycles per inch.

8. The body support of claim 1, wherein said support member comprises a plurality of foam layers.

9. A multi-zone support comprising:

a top layer, a middle layer located beneath said top layer, and a bottom layer located beneath said middle layer, wherein each of said top, middle and bottom layers includes a head end and a foot end:

wherein said middle layer includes a plurality of zones of support being arrayed from said head to said foot of said middle layer; and wherein said zones of support afford varying degrees of resistance to a compressing force applied to said multi-zone support and wherein said top, middle and bottom layers provide varying degrees of resistance to said compressing force, said resistance increasing from said top layer to said bottom layer.

10. The multi-zone support of claim 9, wherein said plurality of zones extend transversely to said head end.

11. The multi-zone support of claim 9, wherein at least one of said top, middle and bottom layers includes a plurality of channels.

12. The multi-zone support of claim 11, wherein said bottom layer includes said plurality of channels.

13. The multi-zone support of claim 12, wherein said multi-zone support is exposed to a body heat of a user and wherein said plurality of channels carry said body heat away from said multi-zone support.

14. The multi-zone support of claim 9, wherein said top, middle and bottom layers provide varying degrees of resistance to a compressing force applied to said multi-zone support.

15. The multi-zone support of claim 14, wherein said resistance to said compressing force increases per layer from said top layer to said bottom layer.

16. The multi-zone support of claim 9, wherein said plurality of zones of support comprise at least five zones of support.

17. The multi-zone support of claim 16, wherein at least one of said at least five zones of support has a sinusoidal surface and wherein at least one of said at least five zones of support has a solid surface.

18. The multi-zone support of claim 17, wherein said zone with said sinusoidal surface is a support section selected from the group consisting of: a head/shoulders support section, a hips support section and a legs/feet support section.

19. The multi-zone support of claim 17, wherein said zone with said solid surface is a support section selected from a group consisting of: a back support section and a thighs support section.

20. The multi-zone support of claim 17, wherein said sinusoidal surface varies in frequency from approximately 0.1 cycles per inch to 0.6 cycles per inch.

21. The multi-zone support of claim 9, wherein said top layer comprises foam having a density in the range of 3.1 to 3.5 pcf and an ILD in the range of 15 to 21.

22. The multi-zone support of claim 9, wherein said middle layer comprises foam having a density in the range of 2.75 to 3.00 pcf and an ILD in the range of 35 to 40.

23. The multi-zone support of claim 9, wherein said bottom layer comprises foam having a density in the range of 3.00 to 3.25 pcf and an ILD in the range of 65–75.

24. A body support system comprising:

a first layer, a second layer beneath said first layer, a third layer beneath said second layer and a fourth layer beneath said third layer, wherein each of said layers includes a head end and a foot end;

wherein at least one of said first, second, third and fourth layers comprises a fluid supported member;

wherein at least one of said first, second, third and fourth layers includes a plurality of zones of support being arrayed from said head to said foot of said layer;

wherein said zones of support afford varying degrees of resistance to a compressing force applied to said body support system; and wherein said first, second, third and fourth layers provide varying degrees of resistance to said compressing force and wherein said resistance to said compressing force increases per layer at least from said first layer to said third layer.

25. The body support system of claim 24, wherein said fourth layer comprises said fluid supported member.

26. The body support system of claim 24, wherein the fluid pressure in said fluid supported system is adjustable.

27. The body support system of claim 24, wherein said plurality of zones are included in said second layer.

28. The body support system of claim 24, wherein said plurality of zones extend transversely to said head end.

29. The body support system of claim 28, wherein at least one of said first, second, third and fourth layers includes a plurality of channels.

30. The body support system of claim 29, wherein said third layer includes said plurality of channels.

31. The body support system of claim 30, wherein said body support system is exposed to a body heat of a user and wherein said plurality of channels carry said body heat away from said body support system.

32. The body support system of claim 24, wherein said plurality of zones of support comprise at least five zones of support.

33. The body support system of claim 32, wherein at least one of said at least five zones of support has a sinusoidal surface and wherein at least one of said at least five zones of support has a solid surface.

34. The body support system of claim 33, wherein said zone with said sinusoidal surface is a support section selected from the group consisting of: a head/shoulders support section, a hips support section and a leg/feet support section.

35. The body support system of claim 33, wherein said zone with said solid surface is a support section selected from a group consisting of: a back support section and a thighs support section.

36. The body support system of claim 33, wherein said sinusoidal surface varies in frequency from approximately 0.1 cycles per inch to 0.6 cycles per inch.

37. The body support system of claim 24, wherein said first layer comprises foam having a density in the range of 3.1 to 3.5 pcf and an ILD in the range of 15 to 21.

38. The body support system of claim 24, wherein said second layer comprises foam having a density in the range of 2.75 to 3.24 pcf and an ILD in the range of 35 to 40.

39. The body support system of claim 24, wherein said third layer comprises foam having a density in the range of 3.00 to 3.25 pcf and an ILD in the range of 65–75.

* * * * *